US006864775B2

(12) United States Patent
Lopez et al.

(10) Patent No.: US 6,864,775 B2
(45) Date of Patent: Mar. 8, 2005

(54) SOLENOID COIL ASSEMBLY

(75) Inventors: Jorge L. Lopez, Chihuahua (MX); Santos Burrola, Chihuahua (MX); Miguel A. Concha, Chihuahua (MX); Luis E Rodriguez, Chihuahua (MX)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/666,713

(22) Filed: Sep. 18, 2003

(65) Prior Publication Data

US 2004/0075519 A1 Apr. 22, 2004

Related U.S. Application Data

(62) Division of application No. 10/265,966, filed on Oct. 7, 2002, now Pat. No. 6,680,666.

(51) Int. Cl.[7] ..... H01F 27/30
(52) U.S. Cl. ..... 336/192; 336/107; 336/198
(58) Field of Search ..... 336/65, 83, 90, 336/92, 107, 192, 198; 439/874, 867–873

(56) References Cited

U.S. PATENT DOCUMENTS

| | | | | |
|---|---|---|---|---|
| 4,954,801 A | | 9/1990 | Urbanski et al. | 336/90 |
| 5,426,410 A | * | 6/1995 | Niimi | 336/192 |
| 5,465,911 A | * | 11/1995 | Hall | 239/585.4 |
| 5,903,206 A | * | 5/1999 | Koga et al. | 336/192 |
| 6,373,363 B1 | | 4/2002 | Spakowski et al. | |
| 6,612,520 B2 | | 9/2003 | Gutierrez et al. | |
| 6,644,585 B2 | | 11/2003 | Gutierrez et al. | |

* cited by examiner

*Primary Examiner*—Tuyen T. Nguyen
(74) *Attorney, Agent, or Firm*—Jimmy L. Funke

(57) ABSTRACT

A coil assembly includes a spool having a wire wound therearound to establish a coil. A spool terminal extends from the spool and the end of the wire is wound around the spool terminal. A connector housing is coupled to the spool and a connector terminal extends therefrom. A portion of the connector terminal is adjacent to a portion of the spool terminal. Thus, the connector terminal can be relatively easily resistance welded or soldered to the spool terminal.

6 Claims, 2 Drawing Sheets

SOLENOID COIL ASSEMBLY

This is a division of application Ser. No. 10/265,966 filed on Oct. 7, 2002 now U.S. Pat. No. 6,680,666.

TECHNICAL FIELD

The present invention relates to solenoids and actuators.

BACKGROUND OF THE INVENTION

Modern motor vehicles are equipped with numerous vehicle subsystems that are designed to increase the comfort and safety of drivers and passengers. For example, a vehicle can include an anti-lock braking system, a traction control system, a speed control system, and/or a vehicle stability enhancement control system. In turn, each subsystem can include numerous electromagnetic sensors and/or actuators that utilize electric coil assemblies to move plungers when energized or to provide control signals in response to changes in magnetic flux around the sensing coils.

In general, these coil assemblies include a plastic "I" shaped spool having a winding bay established around it. A coil of wire is formed within the winding bay. The spool is mated with a connector housing having one or more terminals to which the coil is electrically connected. Typically, during manufacturing, the spool is loaded into a winding machine that automatically winds a thin wire around the spool within the winding bay in order to form the coil. The ends of the wire are manually stripped and wrapped around connector terminals. Thereafter, the ends of the wire are manually soldered to the connector terminals. It can be appreciated that the manual steps increase manufacturing time and costs.

The present invention has recognized the prior art drawbacks, and has provided the below-disclosed solutions to one or more of the prior art deficiencies.

SUMMARY OF THE INVENTION

A coil assembly includes a spool having a wire wound around it to establish a coil. A spool terminal extends from the spool and a portion of the wire is wound around the spool terminal. A connector housing is coupled to the spool and a connector terminal extends from the connector housing. A portion of the connector terminal is adjacent to a portion of the spool terminal and is electrically connected thereto.

In one aspect of the present invention, a first arm extends from the connector terminal such that it flanks the spool terminal. Moreover, a second arm extends from the connector terminal such that flanks the spool terminal. Thus, the spool terminal is between the first and second arms.

In another aspect of the present invention, the spool defines a top and the spool terminal extends perpendicularly from the top of the spool. Also, the connector housing defines a top and the connector terminal includes a lower connector terminal portion that extends perpendicularly from the top of the connector housing. A lateral connector terminal portion extends perpendicularly from the lower connector terminal portion toward the spool. Also, an upper connector terminal portion extends perpendicularly from the lateral connector terminal portion such that it is parallel and adjacent to the spool terminal. In this aspect, the first arm and the second arm extend perpendicularly from the upper connector terminal portion around the spool terminal and the spool terminal is electrically connected to the connector terminal by resistance welding or soldering.

In yet another aspect of the present invention, the spool defines a top and the spool terminal includes a lower spool terminal portion that extends perpendicularly from the top of the spool. Moreover, an upper spool terminal portion extends perpendicularly from the lower spool terminal portion toward the connector housing. The connector housing defines a top and the connector terminal includes a lower connector terminal portion that extends perpendicularly from the top of the connector housing. Also, an upper connector terminal portion extends perpendicularly from the lower connector terminal portion such that it is parallel and adjacent to the spool terminal. In this aspect the first arm and the second arm extend perpendicularly from the upper connector terminal portion around the spool terminal. Also, the spool terminal is electrically connected to the connector terminal by resistance welding or soldering.

In still another aspect of the present invention, the spool defines a top and the spool terminal extends perpendicularly from the top of the spool. Also, the connector housing defines a top and the connector terminal comprises a lower connector terminal portion extends perpendicularly from the top of the connector housing. A lateral connector terminal portion extends perpendicularly from the lower connector terminal portion toward the spool and an upper connector terminal portion extends perpendicularly from the lateral connector terminal portion such that it is parallel and adjacent to the spool terminal. Thus, the spool terminal can be resistance welded or soldered to the connector terminal.

In yet still another aspect of the present invention, a terminal assembly includes an electrical device. An electrical device terminal extends from the electrical device. A portion of a wire is wound around the electrical device terminal. A connector device is coupled to the electrical device and a connector device terminal extends from the connector device. A portion of the connector device terminal is adjacent to a portion of the electrical device terminal and is electrically connected thereto.

The present invention will now be described, by way of example, with reference to the accompanying drawings, in which:

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
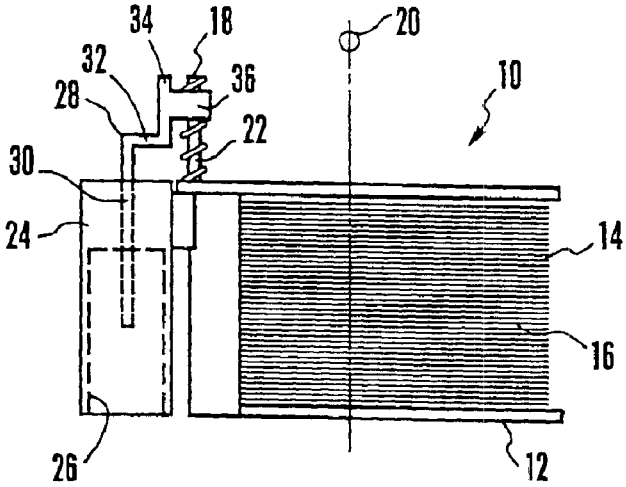
FIG. 1 is a side plan view of a coil assembly.
Figure 2:
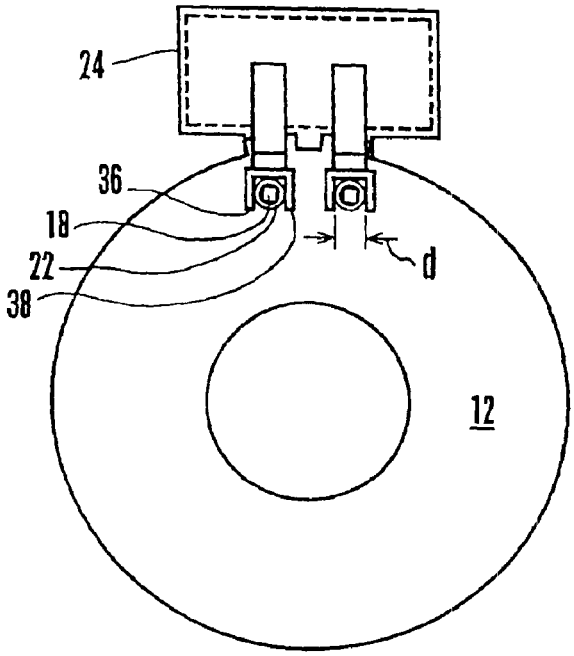
FIG. 2 is a top plan view of the coil assembly shown in FIG. 1.

Referring to FIGS. 1 and 2, a coil assembly is shown and generally designated 10. FIGS. 1 and 2 show that the coil assembly 10 includes a preferably "I" shaped spool 12 around which a relatively thin, preferably copper wire 14 is wound to form a coil 16. As shown, at least one, but preferably two spool terminals 18 extend perpendicularly from the top of the spool 12 such that they are parallel to a longitudinal axis 20 defined by the coil assembly. In a preferred embodiment, the spool terminals 18 have a cross-section that is square. The wire 14 defines two ends 22 and each end 22 of the wire 14 is wrapped around a respective spool terminal 18.

FIGS. 1 and 2 show that the coil assembly 10 also includes a connector housing 24 that is mechanically coupled to the spool 12. As shown, the connector housing 24 forms an internal cavity 26 that is sized and shaped to receive a male electrical connector that can be electrically connected to a vehicle control system. Moreover, the connector housing 24 includes at least one, but preferably two connector terminals 28.

It is to be understood that the connector terminals 28 are identical to each other and that each includes a lower connector terminal portion 30 that extends from within the cavity 26 through the connector housing 24 and beyond the top thereof. As shown, the lower connector terminal portion 30 of each connector terminal 28 is parallel to the longitudinal axis 20 of the coil assembly 10. A lateral connector terminal portion 32 extends perpendicularly from the lower connector terminal portion 30 toward the spool 12. Moreover, an upper connector terminal portion 34 extends perpendicularly from the lateral connector terminal portion 32 in an upward direction such that it is parallel to the longitudinal axis 20. It is to be understood that when the connector housing 24 is coupled to the spool 12, the upper connector terminal portion 34 of each connector terminal 28 is slightly spaced from a respective spool terminal 18.

FIGS. 1 and 2 show that a first arm 36 and a second arm 38 extend perpendicularly from the upper connector terminal portion 34 of each connector terminal 28 such that the arms 36, 38 of each connector terminal 28 flank a respective spool terminal 18 when the connector housing 24 is mechanically coupled to the spool 12. It can be appreciated that the arms 36, 38 of each connector terminal 28 are spaced a distance, d, from each other that is slightly larger that the width of a spool terminal 18 plus twice the diameter of the wire end 22 that is wound around the spool terminal 18. Accordingly, during assembly, when the spool 12 is coupled to the connector housing 24 the arms 36, 38 of each connector terminal 28 fit around a respective spool terminal 18 and are preferably resistance welded thereto.

Figure 3:
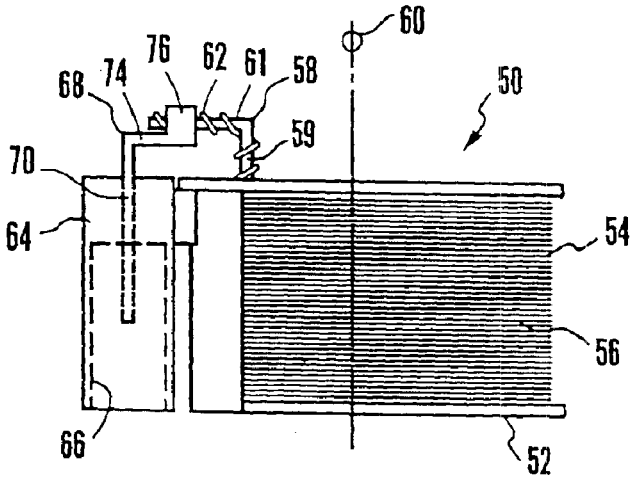
FIG. 3 is a side plan view of an alternative coil assembly.
Figure 4:
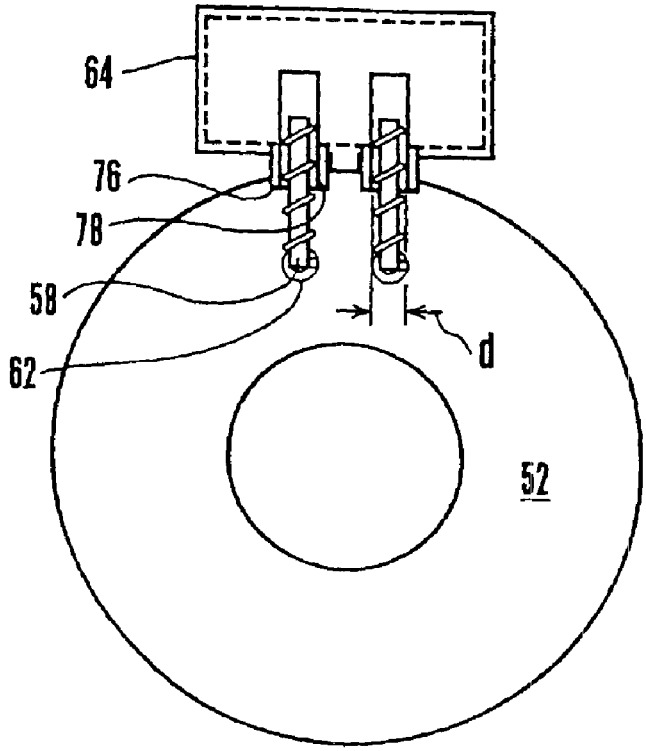
FIG. 4 is a top plan view of the coil assembly shown in FIG. 3.

Referring now to FIGS. 3 and 4, an alternative coil assembly is shown and generally designated 50. FIGS. 3 and 4 show that the coil assembly 50 includes a preferably "I" shaped spool 52 around which a relatively thin, preferably copper wire 54 is wound to form a coil 56. As shown, at least one, but preferably two spool terminals 58 extend from the top of the spool 52. As shown, each spool terminal 58 includes a lower spool terminal portion 59 that extends from the top of the spool 52 such that it is parallel to a longitudinal axis 60 defined by the coil assembly 50. Also, each spool terminal 58 includes an upper spool terminal portion 61 that extends radially from the lower spool terminal portion 59 such that it is perpendicular to the longitudinal axis 60. It is to be understood that the wire 54 defines two ends 62 and each end 62 of the wire 54 is wrapped around a respective spool terminal 58.

FIGS. 3 and 4 show that the coil assembly 50 also includes a connector housing 64 that is mechanically coupled to the spool 52. As shown, the connector housing 64 forms an internal cavity 66 that is sized and shaped to receive a male electrical connector leading to and from a vehicle control system. Moreover, the connector housing 64 includes at least one, but preferably two connector terminals 68.

It is to be understood that the connector terminals 68 are identical to each other and that each includes a lower connector terminal portion 70 that extends from within the cavity 66 through the connector housing 64 and beyond the top thereof. As shown, the lower connector terminal portion 70 of each connector terminal 68 is parallel to the longitudinal axis 60 of the coil assembly 50. An upper connector terminal portion 74 extends perpendicularly from the lower connector terminal portion 70 toward the spool 52. It is to be understood that when the connector housing 64 is coupled to the spool 52, the upper connector terminal portion 74 of each connector terminal 68 is beneath and slightly spaced from a respective spool terminal 58.

FIGS. 3 and 4 show that a first arm 76 and a second arm 78 extend perpendicularly from the upper connector terminal portion 74 of each connector terminal 68 such that the arms 76, 78 of each connector terminal 68 flank a respective spool terminal 58 when the connector housing 64 is mechanically coupled to the spool 52. It can be appreciated that the arms 76, 78 of each connector terminal 68 are spaced a distance, d, from each other that is slightly larger that the width of a spool terminal 58 plus twice the diameter of the wire end 62 wound therearound. Accordingly, during assembly, when the spool 52 is coupled to the connector housing 64 the arms 76, 78 of each connector terminal 76 fit around a respective spool terminal 58 and are preferably resistance welded thereto.

Figure 5:
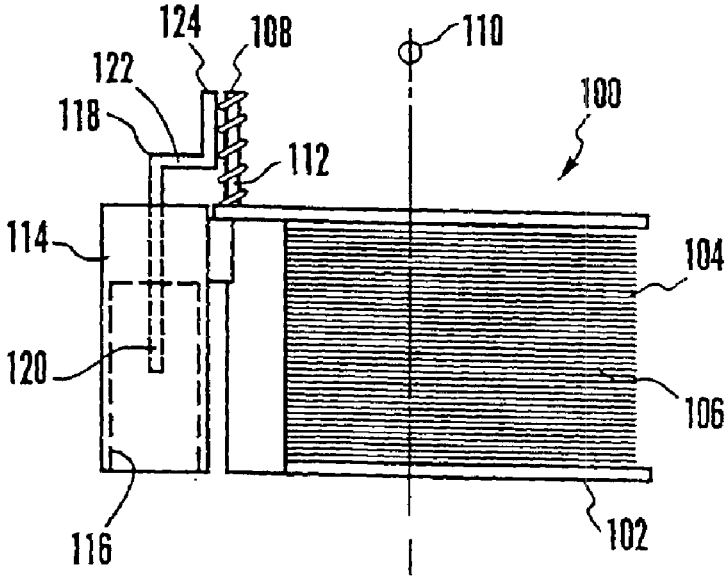
FIG. 5 is a side plan view of a second alternative coil assembly.

Referring to FIG. 5, a coil assembly is shown and generally designated 100. FIG. 5 shows that the coil assembly 100 includes a preferably "I" shaped spool 102 around which a relatively thin, preferably copper wire 104 is wound to form a coil 106. As shown, at least one, but preferably two spool terminals 108 extend perpendicularly from the top of the spool 102 such that they are parallel to a longitudinal axis 110 defined by the coil assembly. The wire 104 defines two ends 112 and each end 112 of the wire 104 is wrapped around a respective spool terminal 108.

FIG. 5 shows that the coil assembly 100 also includes a connector housing 114 that is mechanically coupled to the spool 102. As shown, the connector housing 114 forms an internal cavity 116 that is sized and shaped to receive a male electrical connector leading to and from a vehicle control system. Moreover, the connector housing 114 includes at least one, but preferably two connector terminals 118.

It is to be understood that the connector terminals 118 are identical to each other and that each includes a lower connector terminal portion 120 that extends from within the cavity 116 through the connector housing 114 and beyond the top thereof. As shown, the lower connector terminal portion 120 of each connector terminal 118 is parallel to the longitudinal axis 110 of the coil assembly 100. A lateral connector terminal portion 122 extends perpendicularly from the lower connector terminal portion 120 toward the spool 102. Moreover, an upper connector terminal portion 124 extends perpendicularly from the lateral connector terminal portion 122 in an upwards direction such that it is parallel to the longitudinal axis 110. It is to be understood that when the connector housing 114 is coupled to the spool 102, the upper connector terminal portion 124 of each connector terminal 118 is slightly spaced from a respective spool terminal 108. Accordingly, during assembly, when the spool 102 is coupled to the connector housing 114 each connector terminal 118 can be preferably soldered to a respective spool terminal 108.

While the particular SOLENOID COIL ASSEMBLY as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

We claim:

1. A terminal assembly, comprising:

at least one electrical device;

at least one electrical device terminal extending from the electrical device;

at least one wire wound at least partially around the electrical device terminal;

at least one connector device coupled to the electrical device; and at least one connector device terminal extending from the connector device, at least a portion of the connector device terminal being adjacent to at least a portion of the electrical device terminal and electrically connected thereto, the connector terminal including a lower connector terminal portion extending from within the housing, a lateral connector terminal portion extending perpendicularly from the lower connector terminal portion, and an upper connector terminal portion extending perpendicularly from the lateral connector terminal portion away from the lower connector terminal portion and housing.

2. The terminal assembly of claim 1, further comprising:

at least a first arm extending from the connector device terminal such that it flanks the electrical device terminal.

3. The terminal assembly of claim 2, further comprising:

at least a second arm extending from the connector device terminal such that it flanks the electrical device terminal.

4. The terminal assembly of claim 3, wherein the electrical device terminal is at least partially between the first and second arms.

5. The terminal assembly of claim 4, wherein the electrical device terminal is at least partially resistance welded to the first and second arms.

6. The terminal assembly of claim 4, wherein the electrical device terminal is at least partially soldered to the first and second arms.

* * * * *